United States Patent [19]

Haarer et al.

[11] Patent Number: 4,782,644

[45] Date of Patent: Nov. 8, 1988

[54] MACHINE FOR SORTING, FILLING AND CLOSING HOLLOW CONTAINERS

[75] Inventors: Rolf Haarer, Winterbach; Theo Moser, Steinenberg; Klaus Reum, Korb, all of Fed. Rep. of Germany

[73] Assignee: Robert Bosch GmbH, Stuttgart, Fed. Rep. of Germany

[21] Appl. No.: 63,207

[22] Filed: Jun. 17, 1987

[30] Foreign Application Priority Data

Aug. 7, 1986 [DE] Fed. Rep. of Germany ..... 3626734

[51] Int. Cl.[4] ..... B65B 1/04; B65B 7/28

[52] U.S. Cl. ..... 53/282; 53/253; 53/319; 53/900

[58] Field of Search ..... 53/253, 282, 319, 276, 53/308, 900

[56] References Cited

U.S. PATENT DOCUMENTS

| | | | |
|---|---|---|---|
| 3,517,480 | 6/1970 | Pinkham | 53/282 X |
| 3,554,412 | 1/1971 | Hayashi | 53/900 X |
| 3,807,467 | 4/1974 | Tascher | 53/319 X |
| 4,731,979 | 3/1988 | Yamamoto et al. | 53/900 X |

*Primary Examiner*—John Sipos

*Attorney, Agent, or Firm*—Edwin E. Greigg

[57] ABSTRACT

A machine for making fuel elements/aerosol generating cartridges useful for smoking articles, the machine providing for receiving a random supply of tubular, open-end containers, orienting the containers to position them for filling, filling the containers with a predetermined amount of aerosol generating material, and capping the open ends by inserting fuel elements therein.

26 Claims, 18 Drawing Sheets

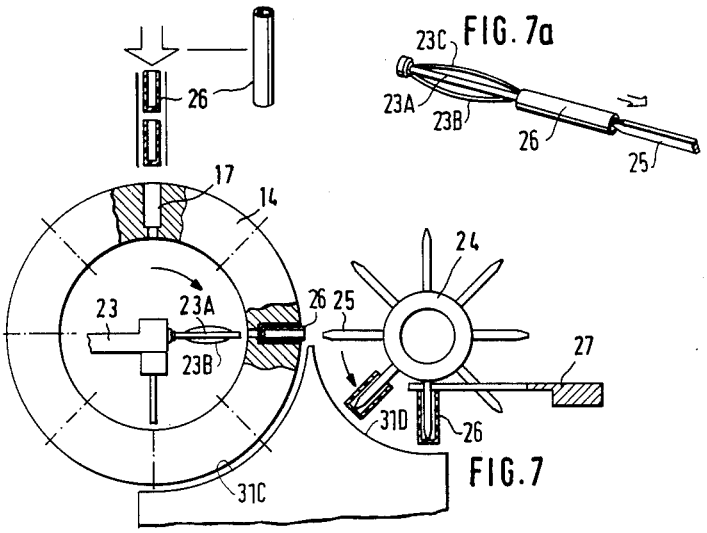
FIG. 7
FIG. 7a
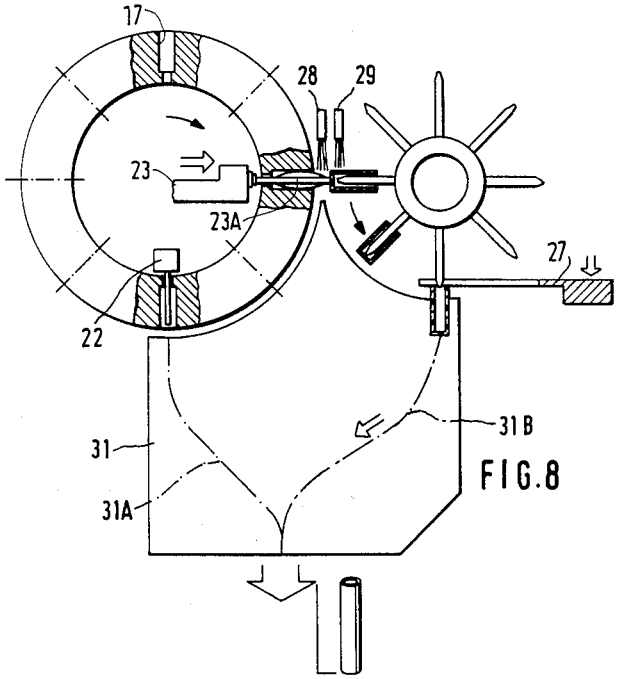
FIG. 8

FIG. 20
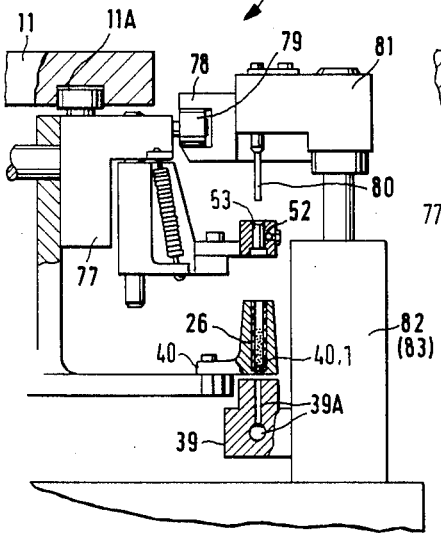
FIG. 21
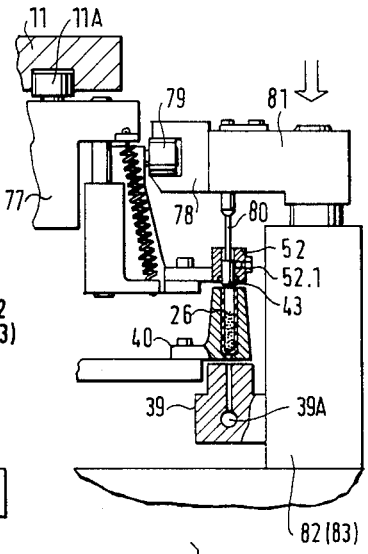
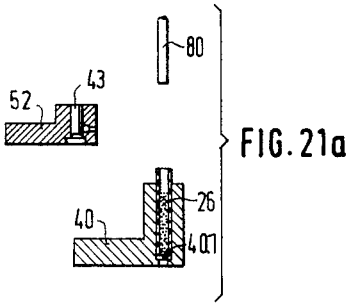
FIG. 21a
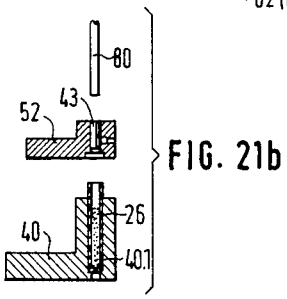
FIG. 21b
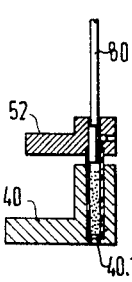
FIG. 21c
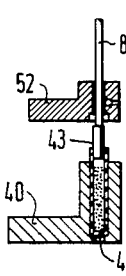
FIG. 21d FIG. 23
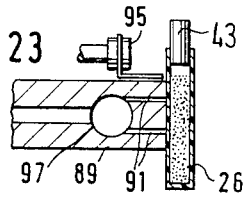
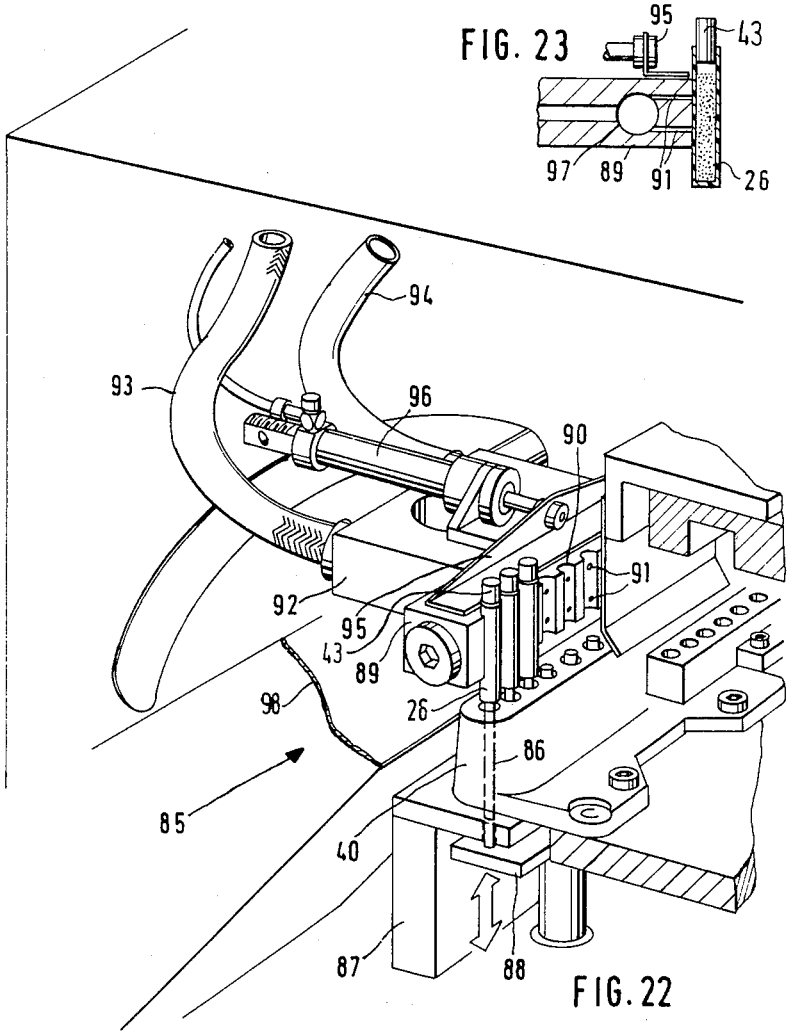
FIG. 22

MACHINE FOR SORTING, FILLING AND CLOSING HOLLOW CONTAINERS

FIELD OF THE INVENTION

This invention relates to filling machines and particularly to machines for sorting, orienting and filling open-ended containers, more particularly to machines for filling and assembling fuel element/aerosol generating cartridges useful for smoking articles.

BACKGROUND OF THE INVENTION

Filling machines are known in the art and are generally designed to receive open containers to be filled upright and thereafter to fill and close them, requiring that the containers be disposed in upright positions before they enter the machine. It is the purpose of this invention to provide an apparatus for filling containers supplied thereto from a random supply of containers by first erecting the containers to dispose them upright and thereafter filling and closing them, thereby eliminating the necessity for predisposing the containers prior to entry into the filling machine More specifically, the apparatus is structured to receive a random supply of open-end capsules, fill them with a predetermined amount of particulate material, for example, aerosol generating material, and insert closures, such as fuel elements, in the open ends.

SUMMARY OF THE INVENTION

In accordance with the invention as herein illustrated, there is shown a machine for sorting, filling and closing elongated containers having at least one open end and a second at least partially closed end. Such containers are useful for holding aerosol generating material used in smoking articles.

In accord with one embodiment of the invention, the machine comprises a rotatable indexing means including a container carrier means and a fuel element or stopper carrier means; a container supply means for providing upwardly-oriented containers to the container carrier means; a stopper supply means including a first receptacle for holding a supply of stoppers and a means for delivering and transferring stoppers to the stopper carrier means of the indexing means; a material supply means including a second receptacle for holding a supply of the material to be loaded into the containers and a means for delivering said material into the open ends of the containers while said containers are supported by the container carrier means of the indexing means; and a means for inserting the stoppers supported by said stopper carrier means into the open ends of the loaded containers while the containers are supported by the container carrier means of the indexing means.

Preferably, the container supply means includes a receptacle for holding a random supply of containers, a sorting means for orienting the containers to a position wherein their open ends are upwardly-oriented, a means for delivering containers from the receptacle to the sorting means, and means for delivering and transferring the upwardly-oriented containers to the container carrier means of the indexing means.

In another embodiment, the machine comprises a first station provided with a receptacle for holding a random supply of containers, sorting means, means for delivering containers from said receptacle to said sorting means for orientation to a position wherein the open ends are disposed uppermost, rotatable indexing means, container carrier means mounted to said rotatable indexing means for receiving the containers from said sorting means, open end uppermost, a second station provided with a receptacle for receiving a supply of stoppers, a stopper carrier mounted to said rotatable indexing means above the container carrier means for receiving stoppers from said receptacle, a third station, a receptacle at the third station for receiving a quantity of free-flowing material, means at said third station for delivering a predetermined quantity of free-flowing material from the receptacle into the open upper end of said container supported on said rotatable indexing means by said container carrier means, a fourth station, and means at said fourth station for inserting stoppers supported by said stopper carrier means into the open ends of the containers supported by said container carrier means.

The containers which are to be filled are hollow cylinders of circular cross section and the stoppers are preferably non-metallic rods of a cross section corresponding substantially to the internal cross section of the hollow metal cylinders. The free-flowing material is preferably granular.

The means for delivering containers to said sorting means comprise a vibrating hopper and parallel guide tracks extending from the hopper to the sorting means and the sorting means comprises a sorting roller and a sorting wheel positioned adjacent thereto, first and second guide tubes disposed with their upper ends adjacent said sorting roller and sorting wheel, respectively, for receiving the containers, open end uppermost, and a third guide tube disposed at the lower end of said first and second guide tubes for receiving containers open end up from said first and second guide tubes. There is transfer means for transferring containers from said third guide track to said container carrier. There is means for effecting vibration of said receptacle for the stoppers, a transfer plate, tracks for delivering the stoppers from the receptacle for the stoppers to said transfer plate, said transfer plate containing passages corresponding in number to the tracks for receiving stoppers from said tracks, a perforated plate containing openings corresponding in number to the passages in the transfer plate disposed between the transfer plate and the stopper carrier, said transfer plate being movable from a position of alignment with the tubes to a position of alignment with the openings in the perforate plate, and plungers supported in alignment with the openings in the perforated plate for transferring the stoppers from the transfer plate through the openings in the perforate plate into the openings in the stopper carrier.

There is apportioning means in the form of a disk containing holes corresponding in number to the holes in the container carrier defining a volume such as to deliver a predetermined quantity of material into each container, and means for supplying material to the apportioning means. A gate is disposed below the disk, movable from a position blocking said holes to a position uncovering the same, and there are plungers disposed above the holes movable through the holes to press the material contained therein into said containers. Desirably, there is vacuum means for retaining the containers on said container carrier.

In another embodiment, the invention provides a machine for making fuel element/aerosol generating cartridges useful in smoking articles such as described in European Application Publication No. 0174645 published Mar. 19, 1986, which is hereby incorporated by reference. In this embodiment, the machine preferably has means for sorting and orienting elongated containers open at one end and at least partially closed at the other end for filling, means for filling the container with an aerosol generating material through the open end, and means for closing the open end by inserting a fuel element therein. More particularly, the machines comprises a rotatable indexing means including a container carrier means and a stopper carrier means; a container supply means for providing upwardly-oriented containers to the indexing means which preferably includes a first receptacle for holding a random supply of containers, a sorting means for orienting the containers to a position wherein their open ends are upwardly oriented, a means for delivering containers from the first receptacle to the sorting means, and means for delivering and transferring the upwardly oriented containers to the container carrier means of the indexing means; a stopper supply means including a second receptacle for holding a supply of fuel elements and a means for delivering and transferring fuel elements to the stopper carrier means of the indexing means; a material supply means including a third receptacle for holding a supply of the aerosol generating material to be loaded into the containers and a means for delivering the material into the open ends of the containers while the containers are supported by the container carrier means of the indexing means; and a means for inserting the fuel elements supported by said stopper carrier means into the open ends of the loaded containers while the containers are supported by the container carrier means of the indexing means.

The invention will now be described with reference to the accompanying drawings, wherein:

BRIEF DESCRIPTION OF THE DRAWINGS

FIGS. 5 to 8 show the mode of operation of the sorting roller;

Figure 9:
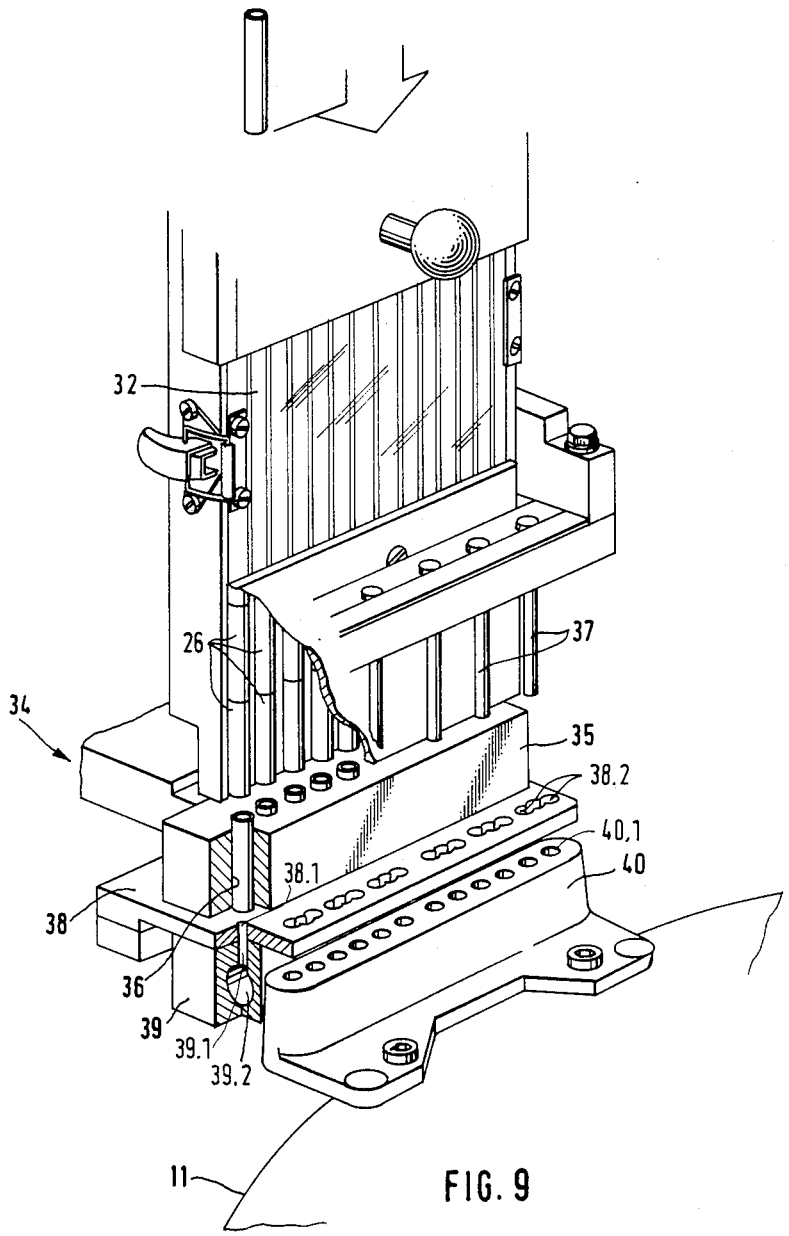
Figure 10:
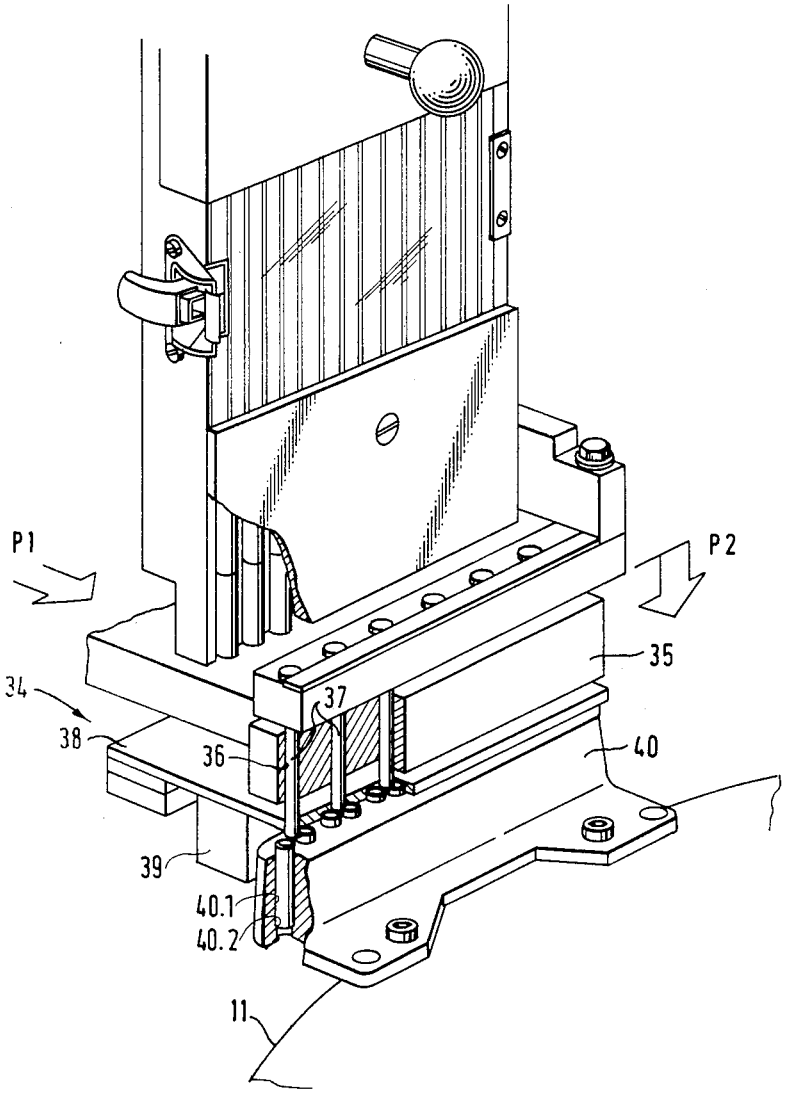
Figure 11:
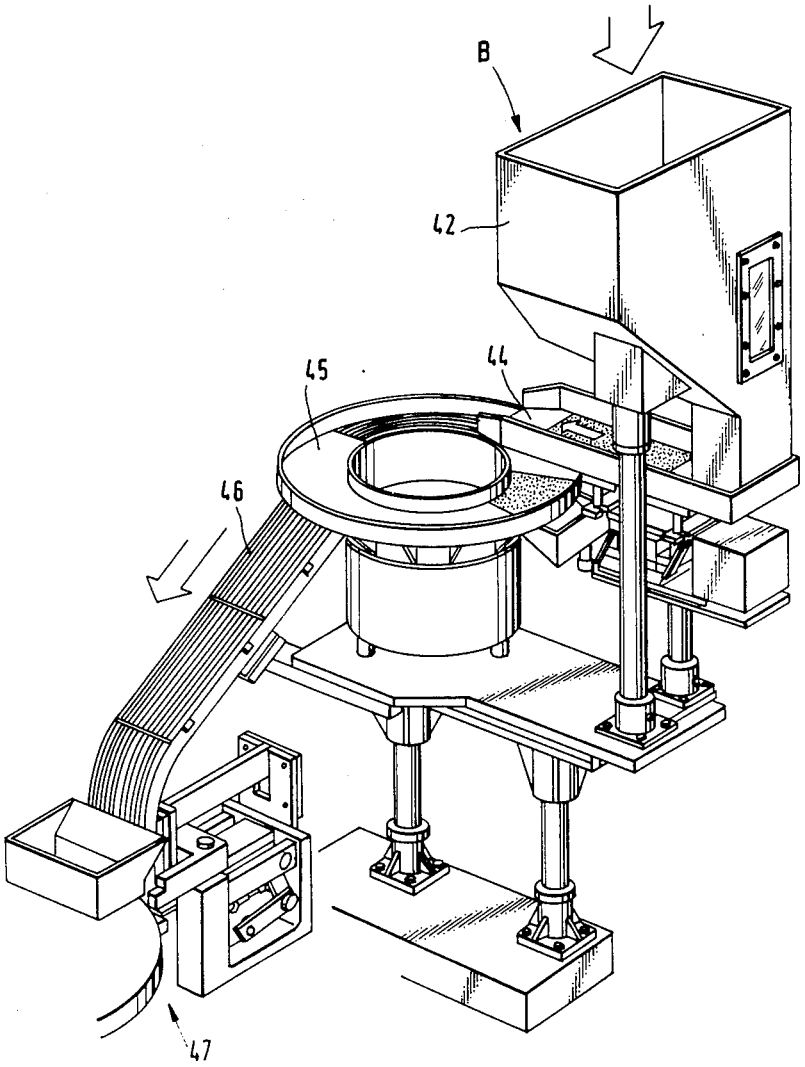
Figure 12:
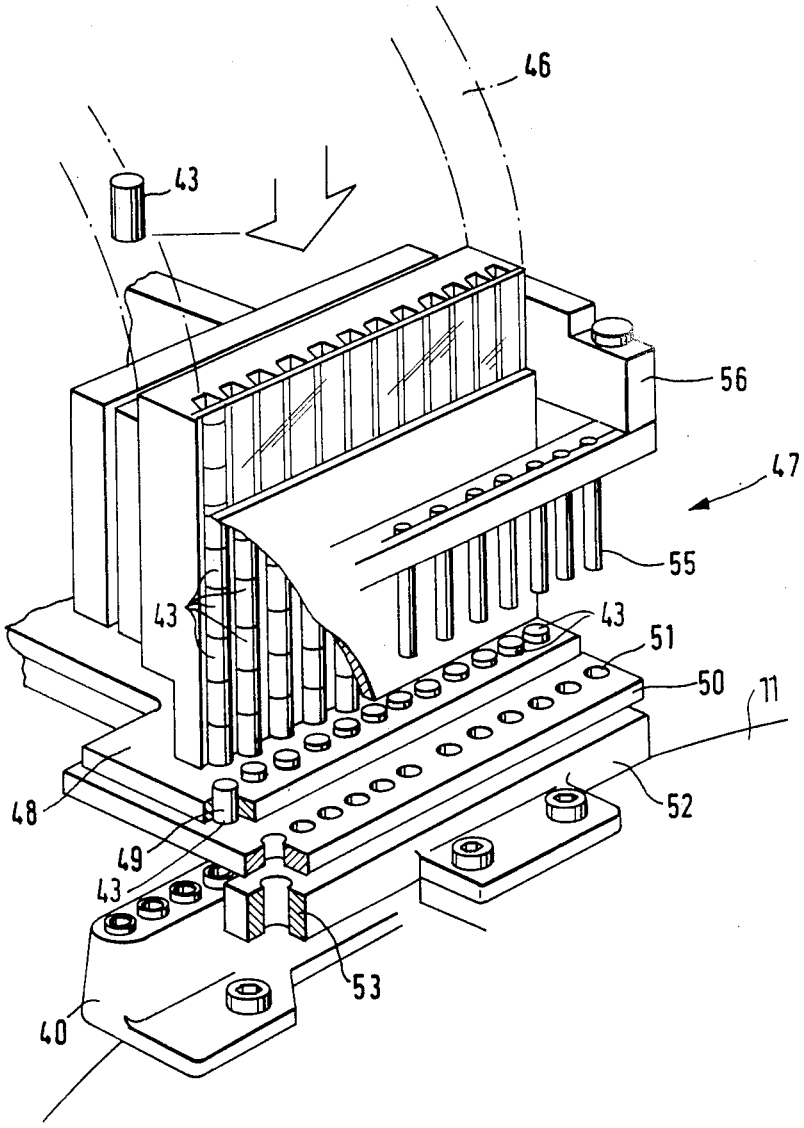
Figure 13:
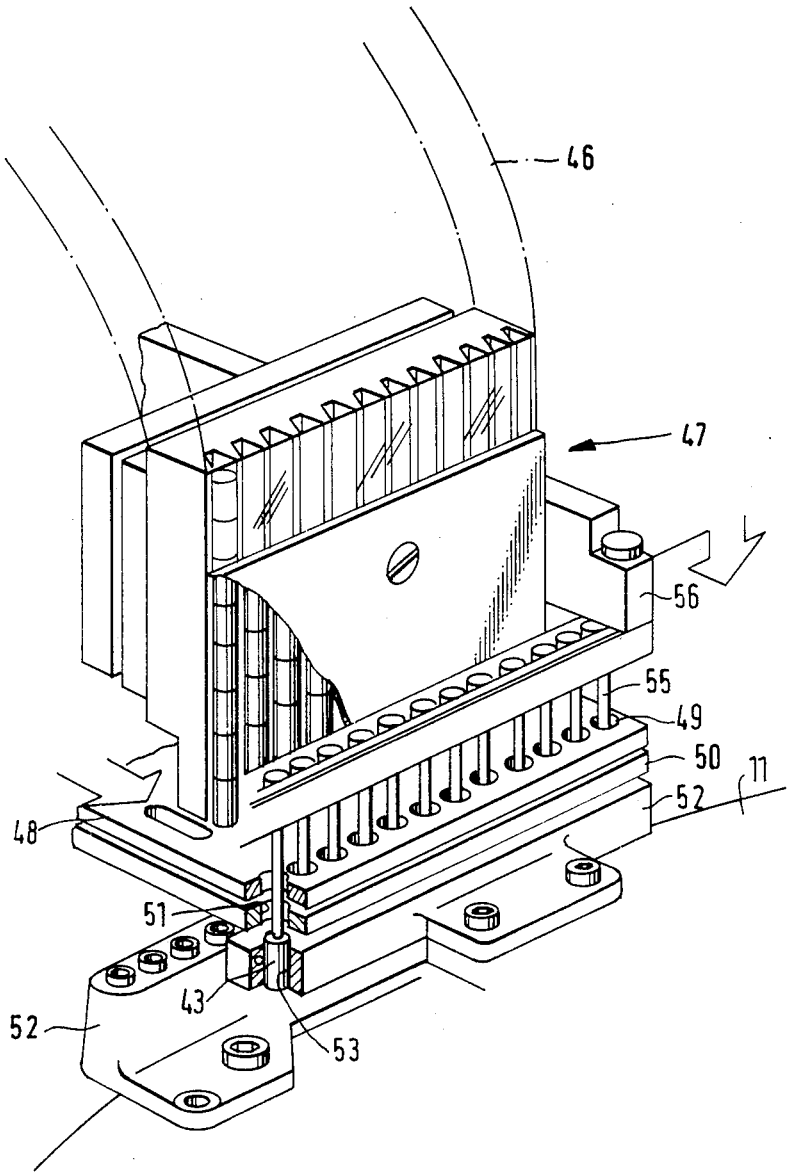
Figure 14:
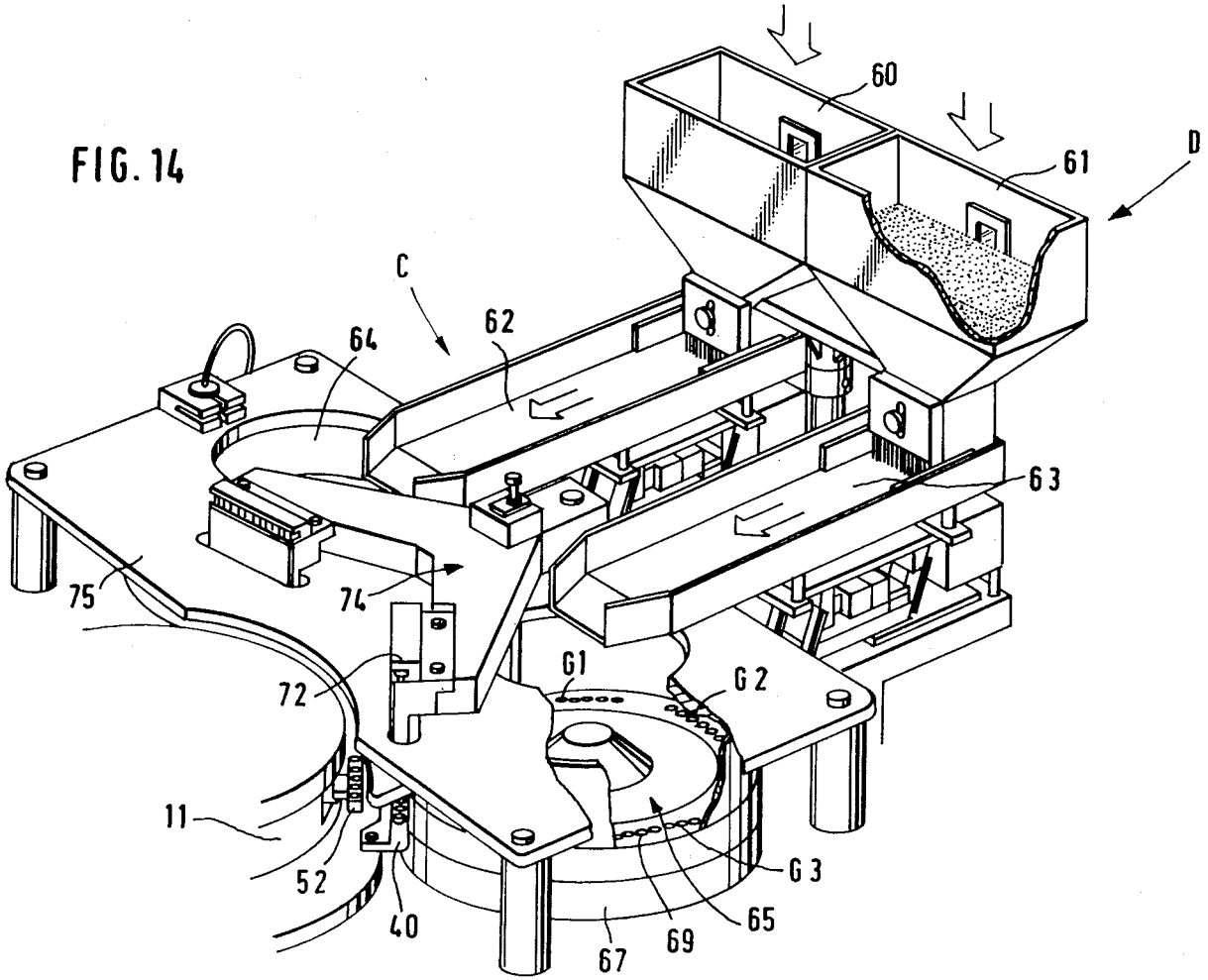
Figure 15:
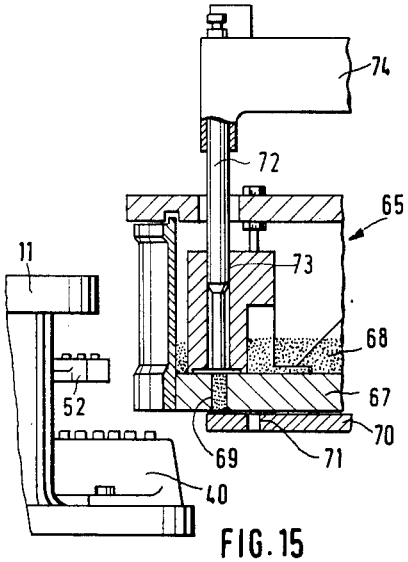
Figure 16:
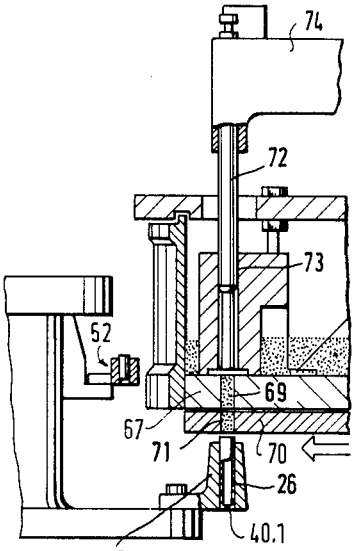
Figure 17:
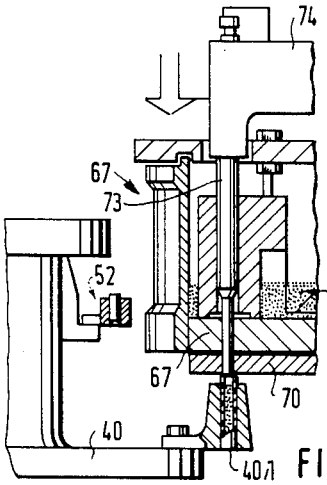
Figure 18:
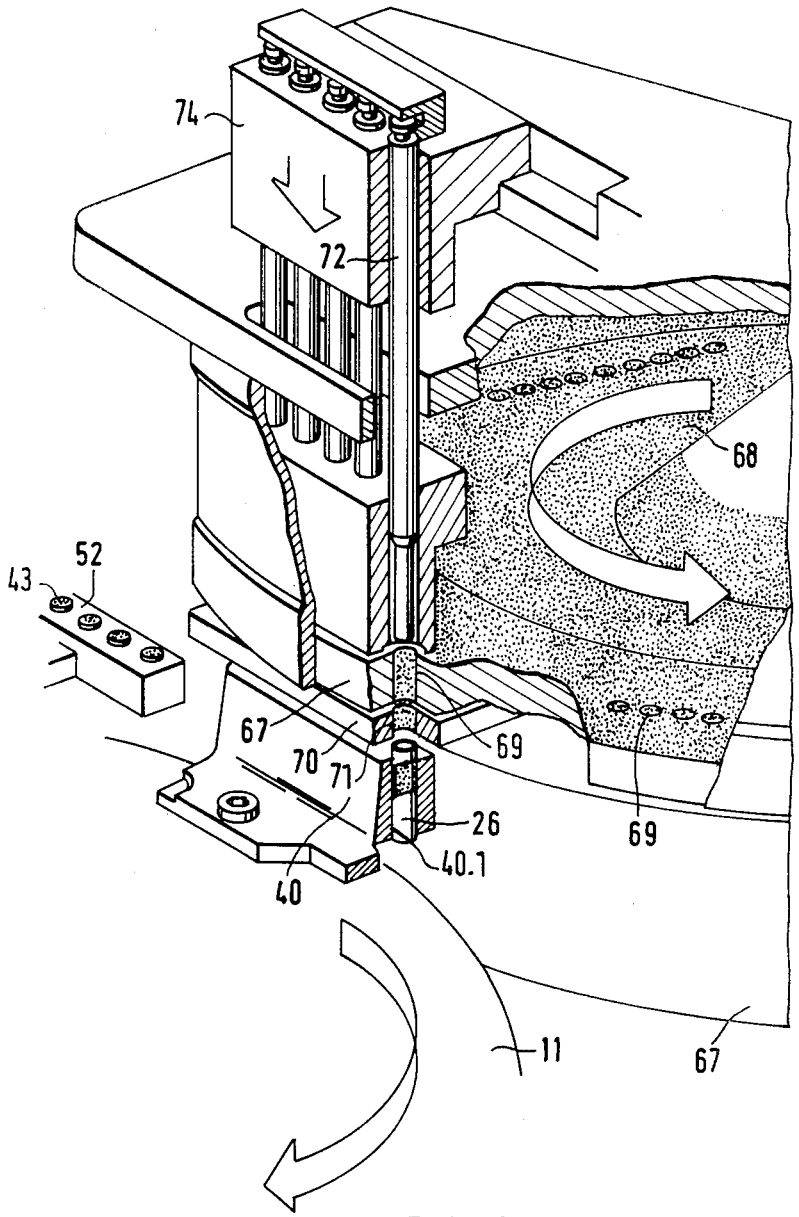
Figure 19:
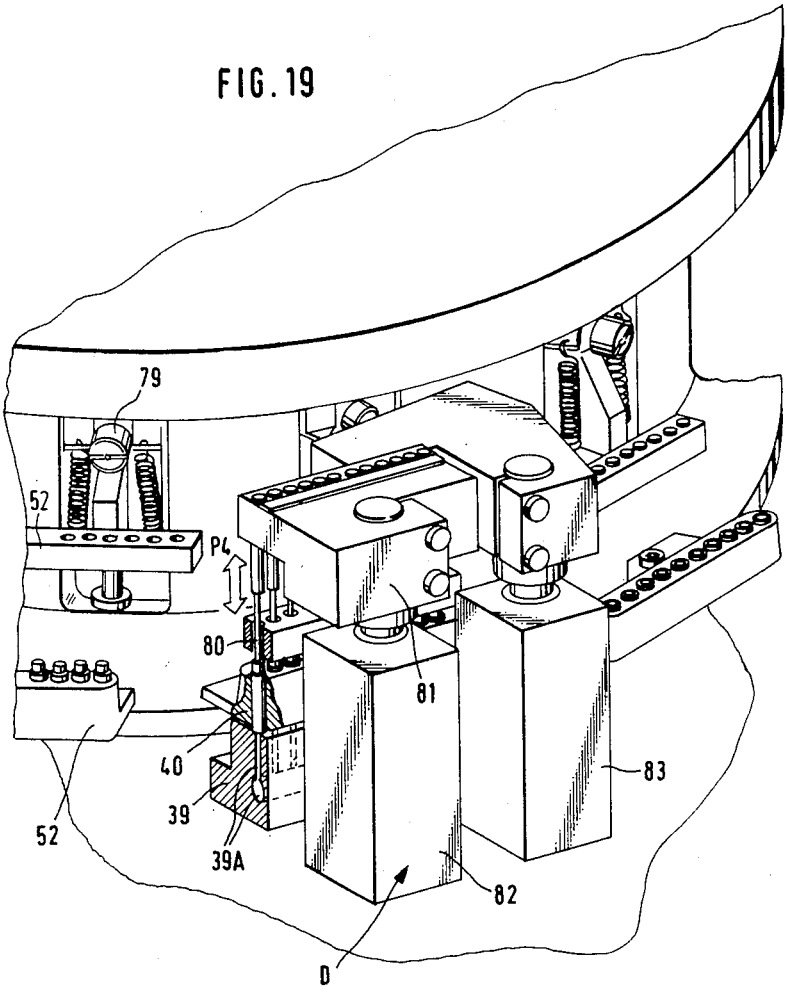
Figure 24:
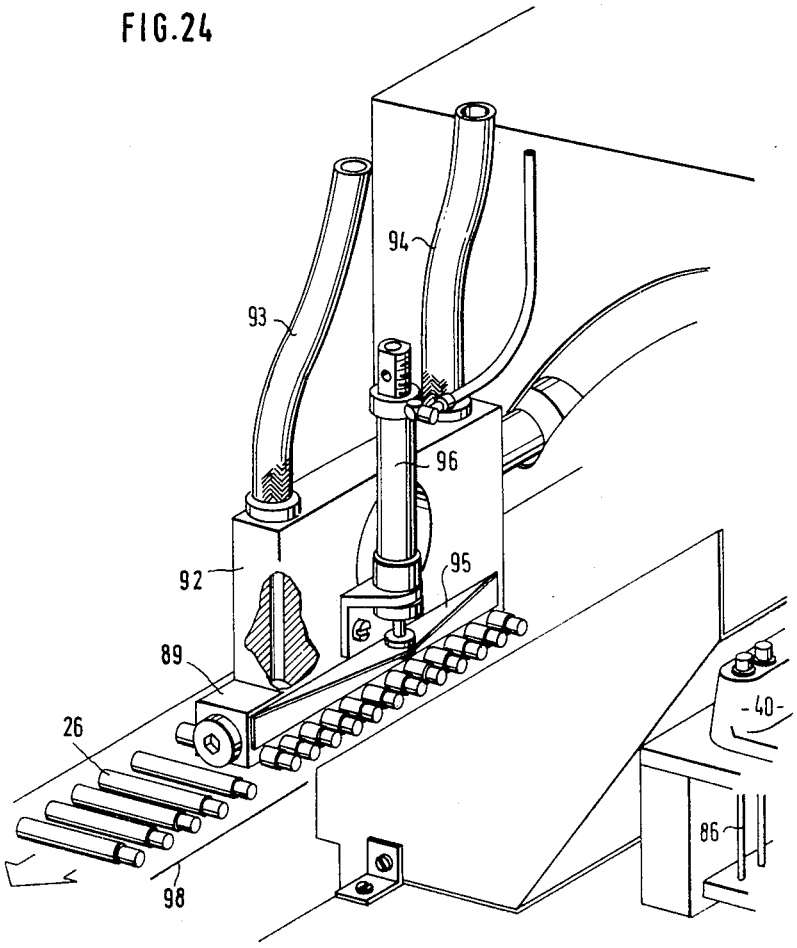

FIG. *5a* diagrammatically shows the sequence of movement of a tube disposed with its open end facing away from the axis of FIG. *7a* diagrammatically shows the sequence of movement of a tube disposed with its open end facing the axis of the FIG. 9 is a perspective view of the station where the tubes are transferred;

FIG. 10 is a perspective view of the transfer station;

FIG. 11 is a perspective view of a second station, where the stoppers are supplied;

FIGS. 12 and 13 are perspective views of the station where the stoppers are transferred;

FIG. 14 is an overall perspective view of how the product is dispensed to the tubes;

FIGS. 15 to 17 show details of how the product is dispensed;

FIG. 18 is a perspective view, in detail, of the transfer of the product;

FIG. 19 is a perspective view of the closing station;

FIGS. 2O and 21 are detailed views of the closing station with FIGS. 21A–1D showing the operation of the closing station; and FIGS. 22 to 24 show the transfer station.

DESCRIPTION OF THE PREFERRED EMBODIMENT

Figure 1:
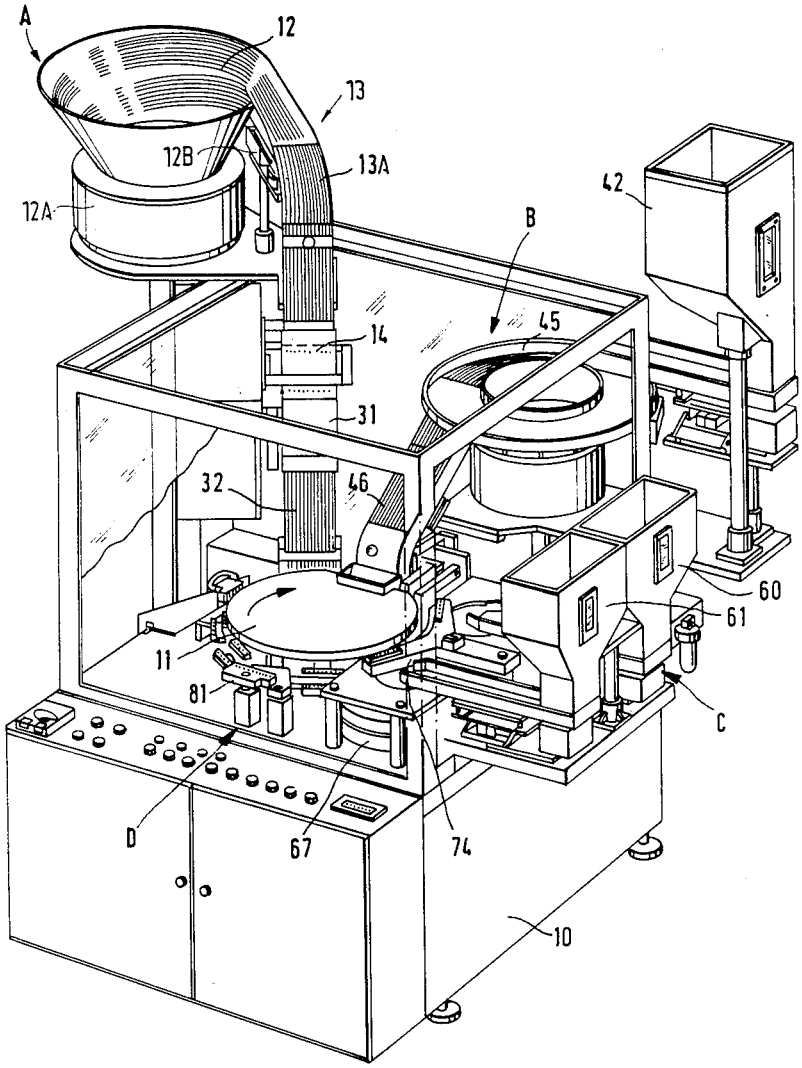
FIG. 1 is a fragmentary perspective view of the entire machine.

Referring to the drawings, FIG. 1 shows a machine frame 10 in which the driving elements of the various stations and equipment are located. The machine comprises four main stations A, B, C and D, wherein A is the station where hollow bodies or containers having one open end and a second closed or partially closed end, hereinafter called tubes, are supplied; B is a station where the stoppers are supplied, C is a product dispensing and apportioning station wherein the tubes are filled with metered portions of a filler material or product and D is a closing station. Also shown in FIG. 1 is an indexing wheel 11 which executes an intermittent rotating movements and which has a plurality of devices to be described hereinafter disposed around it.

Figure 2:
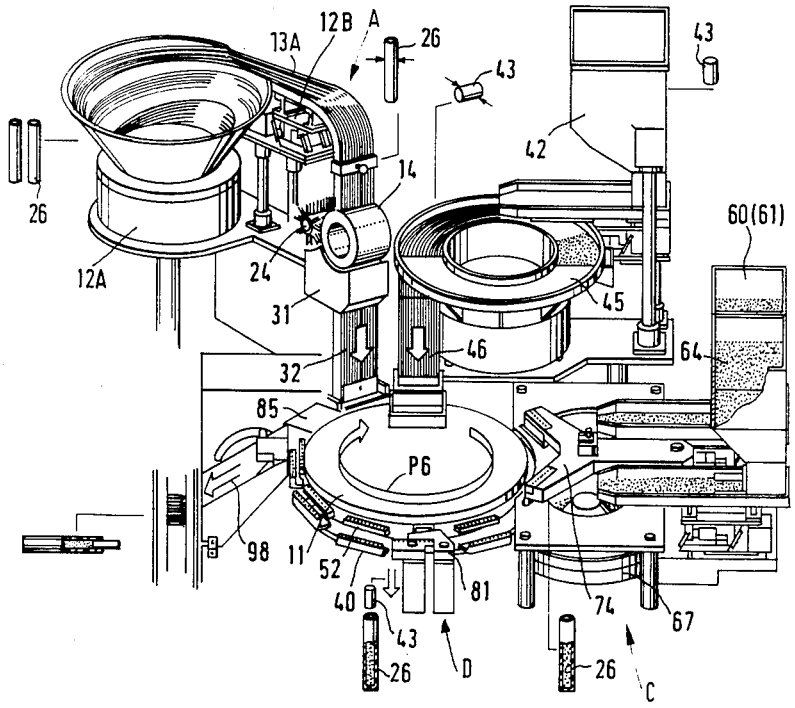
FIG. 2 is a perspective view of the four most important stations.
Figure 3:
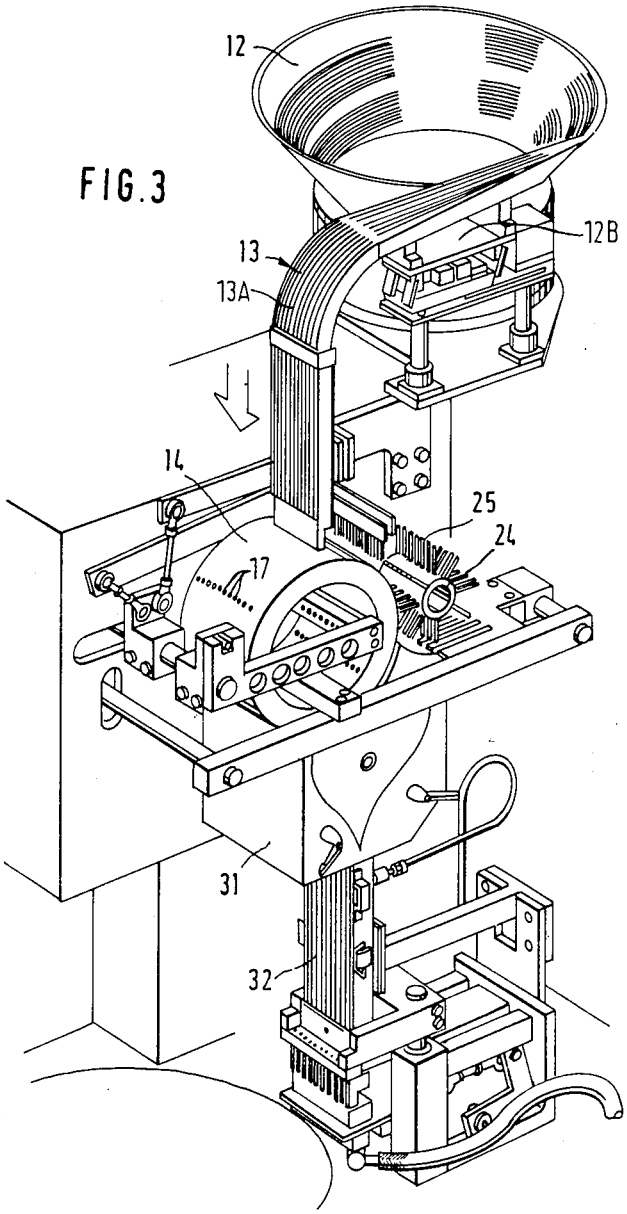
FIG. 3 is a perspective view of a sorting roller with a vibrating conveyor.

The tube supply station A, FIG. 1, 2 and 3, comprises a hopper 12 from which extends a distributor 13 embodying a plurality of guide tracks 13A located parallel to one another. The hopper 12 is filled with randomly-oriented tubes 26 which have been deposited therein by a device, not shown. Electromagnetic vibrating means 12A,12B associated with the hopper 12 and distributor 13 provide for effecting longitudinal orientation of the tubes for introduction into the guide tracks 13A. From the guide tracks 13A wherein some of the tubes 26 have their open ends at the top and others have their open ends at the bottom, the tubes 26 enter a hollow sorting roller 14 which is shown in greater detail in FIGS. 3 to 8. The sorting roller I4 has for its purpose, in conjunction with a sorting wheel 24, also shown in FIGS. 3 to 8 to be described hereinafter, to provide uniform orientation of all of the tubes in one direction, to wit, with their open ends up for deposit in a common guide track 32 situated below the rollers 14 and 24.

Figure 4:
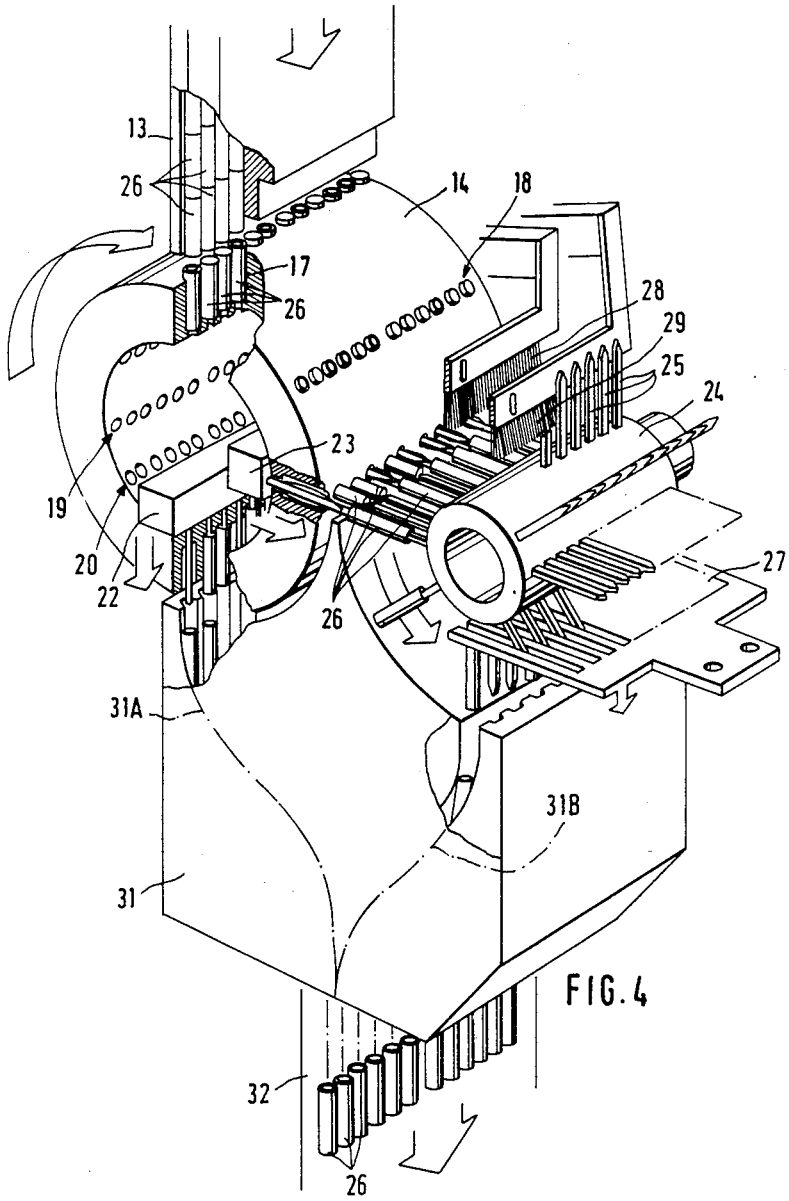
FIG. 4 is a perspective view of the sorting roller in detail.

The sorting roller 14 is supported for rotation about a horizontal axis, is rotated intermittently by way of a gear, not shown, and has a relatively large number of radially-extending through bores 17 which are located in peripherally-spaced rows 18, 19, 20, FIG. 4, parallel to its axis so that a relatively large number of rows are distributed uniformly over the circumference of the sorting roller.

Figure 5:
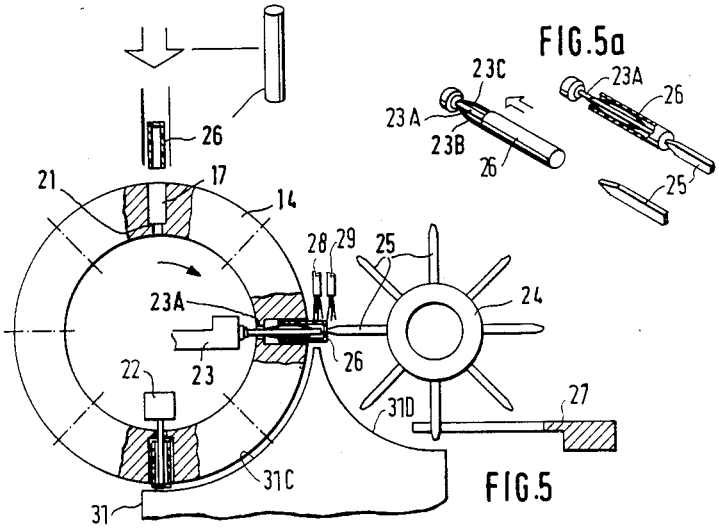
Figure 6:
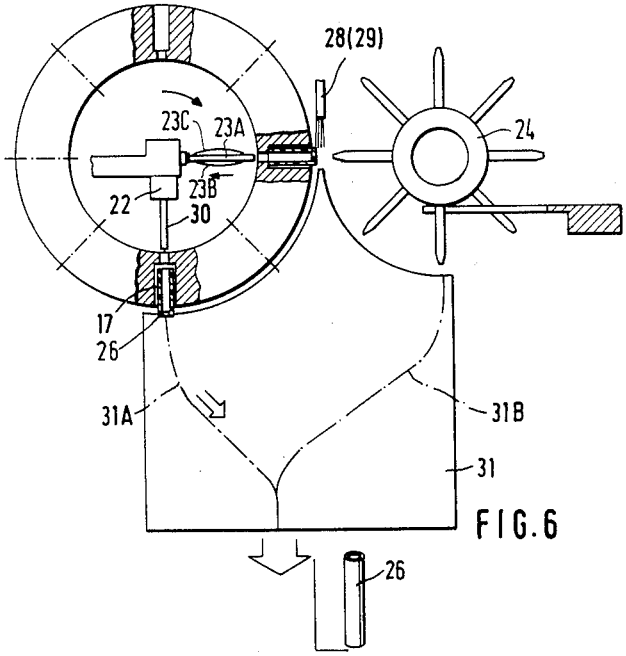

The guide tracks 13A conduct the tubes from the distributor 13 to the sorting roller 14 where they drop into the bores 17 into engagement with stops 21 at the inner ends of the bores, FIG. 4 the latter being of a radial length corresponding to substantially the length of the tubes so that the tubes are substantially completely sheathed in the bores. Some of the tubes will be located in the sorting roller 14 with their open ends disposed inwardly toward the axis of the sorting roller, while others will be located with their open ends facing outwardly away from the axis of the sorting roller. FIGS. 5 and 6 illustrate the tubes disposed with their open ends facing inwardly and FIGS. 7 and 8 illustrate the tubes disposed with their open ends facing outwardly. The purpose of the sorting roller 14 is to transfer those tubes delivered into the bores with the open ends disposed inward to the guide tracks 32, FIGS. 3 and 4, and to deliver the tubes disposed with their open ends disposed outwardly to the sorting wheel 24 which, in turn, will deliver the tubes to the guide tracks 32.

Referring to FIGS. 5 and 6, the sorting wheel 24 is rotatable about a horizontal axis parallel to the axis of rotation of the sorting roller 14 with the same indexing rotational movement as the sorting roller. At the outer circumference of the sorting wheel 24, there are a number of radially outwardly oriented pins or spokes 25 corresponding in number with the bores 17 for receiving those tubes disposed in the bores with the open ends disposed outwardly. The lengths of these spokes 25 is somewhat greater than the length of the tubes 26 and they correspond in number of the bores 17 in the sorting roller 14.

As heretofore mentioned, the tubes 26 delivered to the sorting roller 14 are located so that, for some, the open ends are disposed outwardly and, for others, the open ends are disposed inwardly. When the tubes 26 and pins 25 face one another in axial alignment, as illustrated in FIGS. 5 and 6, the tubes 26 which are so positioned in the bores 17 that their closed ends are disposed outwardly, will be moved by the tappets 23A mounted to horizontally-reciprocal slide 23 disposed within the sorting roller 14 into engagement of their closed ends with the pins 25. Diametrically-disposed springs 23B and 23C mounted to each tappet 23A are moved by movement of the tappets into the tubes into frictional engagement with the walls thereof and when the slides 23 are retracted, they pull the tubes back as far as the stops 21. Retaining brushes 28, FIGS. 5 and 6, are provided to prevent the tubes from sliding out of the bores. Further rotation of the sorting roller 14 moves the bores 17 and, hence, the tubes contained therein to a vertical position, FIG. 6, whereupon tappets 30 mounted to vertically-reciprocable ejectors 22 push the tubes from the bores into a guide track 31A of a guide section 31 from which the tubes having the closed ends disposed downwardly, in turn, enter into the guide tracks 32, FIG. 4, that extend vertically downward.

If a tube 26 enters the bore 17 of the sorting roller 14 in a position such that its open end is disposed outwardly, as illustrated in FIGS. 7 and 8, then it is pushed directly by the slide 23 and its tappet 23A onto a pin 25 of the sorting wheel 24. Retaining brushes 29 prevent the tube from dropping off the pin 25. By means of the sorting wheel 24, the tubes 26 are rotated to a vertical position and by means of the vertically-reciprocable movement of ejector plates 27, the tubes having their closed ends disposed downwardly enter a second guide track 31B of the guide section 31 and from thence descend into the guide tracks 32.

In order to prevent the tubes from falling out of the bores 17 and/or off the pins 25, there are provided retaining surfaces 31C and 31D concentric, respectively, with the sorting roller 14 and the sorting wheel 24. FIGS. 8A and 8B diagrammatically portray the delivery of open-end tubes to the sorting roller 14 and retention of the tubes by the sorting wheel 24.

From the foregoing, it is evident that all of the tubes which are delivered to the sorting roller 14 or to the sorting wheel 24 are ultimately delivered to the guide tracks 32 with their open ends at the top. This sorting device is described in detail in copending U.S. Pat. Ser. No. 063,039, filed simultaneously with the present application and is owned by a common assignee, which is hereby incorporated by reference.

From the guide tracks 32, the tubes are delivered to tube transfer means 34, FIGS. 9 and 10. The tube transfer means comprise a horizontally-reciprocal transfer slide 35 which contains a number of vertical through bores 36 corresponding to the number of guide tracks. Below the transfer slide 35, there is a bearing plate 38 containing small diameter bores 38.1 corresponding in number to the bores 36 and below the bearing plate 38, there is a manifold block 39 containing bores 39.1 corresponding in number to the bores 38 1. The bores 39.1 are connected by means of passages 39.2 to a source of low pressure such that a vacuum is maintained in the bores 38.1 which augments deposit of the tubes into engagement with the bearing plate 38. At the forward edge of the bearing plate, there are vertically-disposed openings 38.2 corresponding in number to the bores 38.1. Below the bearing plate 38 and located radially outwardly of it with respect to the indexing wheel 11, FIGS. 9 and 10, there is a tube carrier 40 containing vertically-disposed openings 40.1 corresponding in number to the bores 38.1. Referring to FIG. 10, the arrow P1 indicates how the transfer slide 35 is pushed to a position above the tube carrier 40, whereupon transfer tappets 37 move downward as indicated by the arrow P2 so as to push the tubes from the slide 35 through the openings 38.2 in the bearing plate 38 and through bores 40 1 in the tube carrier 40 wherein they are retained by stops 40.2, FIG. 10. The horizontally-reciprocal movement of the slides 35 are effected by cams and tappets, not shown, which are located outside the indexing wheel 11. The last-mentioned elements, that is, the elements of the tube transfer means 34 and the transfer slide 35 through which the tubes are transferred into the tube carrier 40, are located at the outer circumference of the indexing wheel 11 The tube carrier 40 is mounted on the outer circumference of the indexing wheel 11 and is moved intermittently clockwise as indicated by the arrow P6 in FIG. 2, that is, from the tube transfer means 34, the tube carrier 40 moves to the stopper supply station B, FIGS. 2 and 11 to 13.

The stopper supply station B, FIG. 11, comprises a supply container 42 containing a quantity of stoppers 43 which preferably are generally of non-metallic material and usually have a cross-sectional appearance so as to fit snugly in the tubes 26 to contain the filling material. Preferably, the material from which the stoppers are made is adapted for the particular use and can be elastomeric or even a carbon plug such as when used for closing an aerosol generating cartridge for use in a smoking article. From the supply container 42, the stoppers 43 travel via reciprocal stopper delivery means 44, FIG. 11, to a vibrating sorting apparatus 45 in which they are aligned and by way of which they reach an inclined guide track 46. At the lower end of the guide track 46 which is vertical at its lower end, there is a transfer station 47, FIG. 12 and 13. The transfer station 47 embodies a transfer slide 48 in which there are a number of through bores 49 corresponding to the number of guide tracks 46. Below the transfer slide 48, there is a perforated plate 50 which contains a corresponding number of through bores 51. Once all the bores 49 are filled with stoppers 43, the transfer slide 48 is shifted so as to align the bores 49 with the bores 51. Below the perforated plate 50, there is a stopper carrier 52 which contains the same number of through bores 53 as the bores 51 in the plate 50. As shown in FIG. 13, the transfer slide 48 and the perforated plate 50 are now moved to a position above the stopper carrier 52, whereupon transfer tappets 55 corresponding in number to the number of bores supported by a holder 56 are moved down and push the stoppers 43 into the bores 53 of the stopper carrier 52. The stoppers are retained in the stopper carriers 52 by vacuum ports 52.1, FIGS. 20 and 21 connected to a source of low pressure. Below the stopper carriers 52, FIG. 14, and radially outward thereof is the tube carrier 40, FIGS. 15, 16 and 17. The tube carrier 40 and the stopper carrier 52 now move to a third station C where product is dispensed into the tubes, FIGS. 15 to 18.

The product dispensing and apportioning station C, FIGS. 1 and 14, comprises two supply containers 60,61 and two reciprocating conveyor devices 62 and 63. The product is typically a free-flowing or granulated material which is delivered by way of the conveyor devices 62,63 to the two apportioning devices 64,65, of which only the apportioning device 65 will be described hereinafter. At the apportioning station, one apportioning device with its associated conveyor and hopper is designed to provide a predetermined volume of material to fill one-half of the charge to the container tube and the other apportioning device to provide the remaining volume of the charge. Thus, two different materials can be filled into the same container tube in sequence. If only one material is desired to fill the entire volume of the container, one apportioning device, suitably dimensioned to deliver the entire predetermined volume, can be used.

Referring to FIGS. 12, 13 and 14, the indexing wheel 11, the tube carrier 40 and the stopper carrier 52 are shown. FIG. 14 clearly shows the tube carrier 40 located radially outward of the stopper carrier 52, that is, outwardly thereof with respect to the center of rotation of the indexing wheel 11. The disposition of the tube carrier 40 relative to the stopper carrier 52 is further shown in FIGS. 15 to 17 inclusive.

The apportioning station 65, FIGS. 15 to 17, embodies a rotatable apportioning disk 67, in the lower portion of which a supply of product 68 is located. The apportioning device is provided at its bottom with a relatively large number of bores 69 combined into a plurality of groups G1,G2,G3 for apportioning by volume. The bores 69 extend through the bottom and at the underside of the bottom there is a blocking slide 70 which is operable, at times, to close the apportioning bores 69. The number of apportioning bores 69 per group G1, G2, G3, FIG. 14, is precisely the same as the number of tubes in the tube carrier 40. The apportioning bores 69 become filled with the granulated product during the rotation of the apportioning disk. Any free-flowing granulated material can be filled into the tubes in accordance with this invention. Examples of such materials include free-flowing carbon particles, alumina particles and the like.

Following filling of the bores 69, the tube carrier 40 is moved beneath the apportioning bores 69 and, at the same time, a gate 70 is shifted so that the apportioning bores 69 and the bores 71 in the gate 70 are now precisely underneath one another, as shown in FIG. 16. Thus, when the apportioning bores 69 are opened, the product drops through the bores 71 into the tubes 26. At the same time, transfer plungers 72 are moved downward through the guide bore 73 and press the product all the way into the tubes, as shown in FIG. 17. The operation is shown again in perspective in FIG. 18.

The next operation takes place at the closing station D. The operation of closing the tubes 26 is shown in FIGS. 19 to 21, wherein FIG. 19 is a perspective view. In the first operation at the closing station D, the stopper carrier 52 is pushed by a slide 77 to a position directly above the tube carrier 40 and moved down toward the tube carrier 40 by means of a cam 78, FIGS. 20 and 21, provided with a roller 79. Once the stopper carrier 52 is located so that the stoppers 43 are positioned exactly above the tubes 26, a reciprocal closing tappet 80 moves downwardly and presses the stopper 43 into the tube 26. The stopper carrier 52 thereupon moves up again so as to prevent the closed tubes from becoming jammed in the stopper carrier. These operations are clearly shown in FIGS. 20 and 21 and diagrammatically in FIG. 21A. A portion of the indexing wheel 11 is also shown herein with cams 11A for moving the stopper carrier 52 and guiding the slide 77. The vacuum produced by the manifold 39 retains the tubes in the carrier 40 when the tappets 80 are withdrawn.

FIGS. 19 to 21 show the closure tappets 80 secured to reciprocating heads 81 which are moved up and down under mechanical power in guides 82 and 83, as indicated by the arrow P4 in FIGS. 19, 20 and 21. The relative positions of the carriers 40,52 and the tappets 80 are diagrammatically illustrated in FIG. 21A.

The last operation in the machine takes place at a transfer station 85, FIGS. 22 to 24. Referring to the aforesaid figures, once the tube carrier 40 has reached the transfer station, the filled and stoppered tubes are expelled at the top by push-up punches 86. The punches 86 are slidingly guided in a holder 87 and are actuated by a lifting plate 88, FIG. 22, that moves up and down. The tubes reach the vicinity of a suction block 89, FIGS. 22 and 23, in which a number of recesses 90 are provided corresponding in number and shape with the stoppered tubes. Suction bores 91, FIG. 23, in which a vacuum prevails terminate at these recesses so that the tubes are firmly held therein. A connecting block 92 is attached to the suction block 89 and hoses 93,94 in which a vacuum is maintained are secured to it. A stripper 95, FIG. 23, which is movable back and forth pneumatically is also located in the vicinity of the upper part of the tubes and is capable of removing the stoppered tubes. The stripper 95 is actuated by means of a pressure cylinder 96. The suction plate 89 and the connecting block 92 are pivotable through an angle of about 90°. At the end of this pivoting movement, the tubes 26 are positioned horizontally on a conveyor belt 98 where they are stripped from the suction plate by a stripper plate 95 and from there they proceed to a batch packaging machine or the like, not shown.

The foregoing relates to a preferred exemplary embodiment of the invention, it being understood that other variants and embodiments thereof are possible within the spirit and scope of the invention, the latter being defined by the appended claims. For example, the tubes are preferably cylindrically-shaped with a circular cross section. However, other cross-sectional shapes can as easily be used with corresponding changes to the bores and other parts of the machine. The tubes are preferably a metal such as aluminum or steel, but can be of other materials depending upon the product or filling material.

What is claimed is:

1. A machine for making fuel element/aerosol generating cartridges for smoking articles by providing elongated containers open at one end and at least partially closed at the other end, filling the containers with an aerosol generating material through the open end, and inserting a fuel element in the open end, the machine comprising:

A. a rotatable indexing means including a container carrier means and a fuel element carrier means;

B. a container supply means for providing upwardly oriented containers to the indexing means;

C. a fuel element supply means including a first receptacle for holding a supply of fuel elements and a means for delivering fuel elements to the fuel element carrier means of the indexing means;

D. a material supply means including a second receptacle for holding a supply of aerosol generating material to be loaded into the containers and a means for delivering the material into the open ends of the containers while the containers are supported by the container carrier means of the indexing means; and E. a means for inserting the fuel elements supported by the fuel element carrier means into the open ends or the loaded containers while the containers are supported by the container carrier means of the indexing means.

2. A machine according to claim 1, further comprising a receptacle for holding a random supply of containers, sorting means for orienting the containers to a position wherein their open ends are upwardly oriented, means for delivering containers from the receptacle to the sorting means, and means for delivering the upwardly oriented containers to the container carrier means of the indexing means.

3. A machine according to claim 2, wherein the sorting means comprises an annular sorting roller having at least one row of bores, each of which is designed to receive a container, and a sorting wheel positioned adjacent thereto having at least one row of outwardly projecting pins, a means for filling the row of bores with containers, a means for rotating the sorting roller to a sorting station at which the row of containers in the roller is aligned with the row of pins on the sorting wheel, a means for selectively transferring containers whose open ends face the pins on the wheel to said wheel and for retaining within the bores containers whose open ends are disposed toward the axis of the roller, and means for discharging the containers from the sorting roller and the sorting wheel so that the containers are aligned in the same orientation.

4. A machine according to claim 3, wherein the discharging means comprises a first guide way positioned below the sorting roller to receive containers from the roller, a second guide way positioned below the sorting wheel to receive containers from the wheel, means for rotating the roller and the wheel to positions at which the containers are transferred to the guide ways, and a third guide way disposed below said first and second guide ways to receive said containers and align them in the same orientation.

5. A machine according to claim 1, wherein the aerosol generating material is a granular material.

6. A machine for sorting, filling and closing elongated containers having an open end and a second at least partially closed end, said machine comprising:

A. a rotatable indexing means including a container carrier means and a stopper carrier means;

B. a container supply means for providing upwardly oriented containers to the indexing means including a first receptacle for holding a random supply of containers, a sorting means for orienting the containers to a position wherein their open ends are upwardly oriented, a means for delivering containers from the first receptacle to the sorting means, and means for delivering and transferring the upwardly oriented containers to the container carrier means of the indexing means;

C. a stopper supply means including a second receptacle for holding a supply of stoppers and a means for delivering and transferring stoppers to the stopper carrier means of the indexing means;

D. a material supply means including a third receptacle for holding a supply of the material to be loaded into the containers and a means for delivering said material into the open ends of the containers while said containers are supported by the container carrier means of the indexing means; and E. a means for inserting the stoppers supported by said stopper carrier means into the open ends of the loaded containers while the containers are supported by the container carrier means of the indexing means.

7. A machine according to claim 6 wherein the sorting means comprises an annular sorting roller having at least one row of through bores, each of which is designed to receive a container, and a sorting wheel positioned adjacent thereto having at least one row of outwardly projecting pins, a means for filling the row of bores with containers, a means for rotating the sorting roller to a sorting station at which the row of containers in the roller is aligned with the row of pins on the sorting wheel, a means for selectively transferring containers whose open ends face the pins on the wheel to said wheel and for retaining within the bores containers whose open ends are disposed toward the axis of the roller, and means for discharging the containers from the sorting roller and the sorting wheel so that the containers are aligned in the same orientation.

8. A machine according to claim 7, wherein the discharging means comprises a first guide way positioned below the sorting roller to receive containers from the roller, a second guide way positioned below the sorting wheel to receive containers from the wheel, means for rotating the roller and the wheel to positions at which the containers are transferred to the guide ways, and a third guide way disposed below said first and second guide ways to receive said containers and align them in the same orientation.

9. A machine for sorting, filling and closing elongated containers having at least one open end and a second at least partially closed end, the machine comprising:

a first station provided with a first receptacle for holding a random supply of containers, sorting means for orienting the containers to a position wherein the open ends are disposed for filling, and means for delivering containers from the first receptacle to the sorting means;

rotatable indexing means and container carrier means movable with the rotatable indexing means for receiving containers from the sorting means;

a second station provided with a second receptacle for receiving a supply of stoppers;

a stopper carrier means movable with the rotatable indexing means for receiving stoppers from the second receptacle, a third station having a third receptacle for receiving a quantity of free flowing material and delivery means for delivering a predetermined quantity of free flowing material from the third receptacle into the open end of the containers supported by the container carrier means;

a fourth station having means for inserting stoppers supported by the stopper carrier means into the open ends of the containers supported by the container carrier means.

10. A machine according to claim 9 wherein the containers are hollow metal cylinders of circular cross section and the stoppers are non-metallic rods of material having a cross section corresponding substantially to the internal cross-sectional shape of the hollow metal cylinders.

11. A machine according to claim 9 wherein the free flowing material is a granular material.

12. A machine according to claim 9 wherein the means for delivering containers to the sorting means comprises a vibrating hopper and parallel guide tracks extending from the hopper to the sorting means.

13. A machine according to claim 9 wherein the sorting means comprises a sorting roller and a sorting wheel positioned adjacent thereto, first and second guide ways disposed with their upper ends adjacent the lower sides of the sorting roller and sorting wheel, respectively, for receiving the containers, open end uppermost, and a third guide way disposed at the lower ends of the first and second guide ways for receiving containers, open end up, from the first and second guide tubes.

14. A machine according to claim 13 comprising transfer means for transferring containers from the third guide way to the container carrier means.

15. A machine according to claim 8 wherein the stopper carrier means has openings for carrying stoppers and further comprising means for effecting vibration of the second receptacle for the stoppers, a transfer plate, tracks for delivering stoppers from the second receptacle to the transfer plate, the transfer plate containing passages corresponding in number to the tracks, the transfer plate being movable from a position of alignment with the tracks to a position of alignment with the openings in the stopper carrier means, and means for transferring stoppers from the transfer plate into the openings in the stopper carrier means.

16. A machine according to claim 8, wherein the stopper carrier means is movable with respect to the container carrier means.

17. A machine according to claim 8 comprising apportioning means for depositing material into the container tube to fill the same, the apportioning means comprising a disk containing holes corresponding to the positions of the containers supported by the container carrier means, the holes in the disk defining a volume to deliver a predetermined quantity of material into each container, means for supplying material to the apportioning means and means for effecting vibration of the apportioning means.

18. A machine according to claim 16 wherein a gate is disposed below the disk, the gate being movable from a position blocking the holes to a position uncovering the same and wherein plungers are disposed above the holes in the disk, the plungers being movable through the holes to press the material contained therein into the containers.

19. A machine according to claim 8 comprising first and second apportioning means for depositing predetermined different amount of different material in sequence into the container to fill the same, each apportioning means comprising a disk containing holes corresponding to the positions of the containers supported by the container carrier means, the holes in the disk defining a volume to deliver a predetermined quantity of material into each container, means for supplying material to the apportioning means, and means for effecting vibration of the apportioning means.

20. A machine according to claim 19 wherein a gate is disposed below the disk, the gate being movable from a position blocking the holes to a position uncovering the same and wherein plungers are disposed above the holes in the disk, the plungers being movable through the holes to press the material contained therein into the containers.

21. A machine according to claim 18 comprising a slide member supporting the stopper carrier means for movement to a position above the container carrier means, and cam means for effecting movement of the slide member to effect alignment of the stopper carrier means with the containers.

22. A machine according to claim 21 comprising vacuum means for retaining the containers on the container carrier means.

23. A machine according to claim 8 comprising suction block means disposed at a station above the container carrier means and plungers arranged to move the filled containers from the container carrier means into engagement with the suction block means.

24. A machine according to claim 23 comprising a conveyor and means supporting the suction block means for rotation to a position to dispose the containers on the conveyor.

25. A machine according to claim 12 further comprising means for intermittent driving of the sorting roller, sorting wheel and indexing wheel in synchronization.

26. A machine according to claim 8 comprising cam means and slide means for effecting operation of the several parts of the machine and means operable by said indexing wheel to effect movement of said cam means and slide means.

* * * * *